US006864883B2

(12) United States Patent
Hector et al.

(10) Patent No.: US 6,864,883 B2
(45) Date of Patent: Mar. 8, 2005

(54) DISPLAY DEVICE

(75) Inventors: Jason R. Hector, Redhill (GB); Steven C. Deane, Redhill (GB)

(73) Assignee: Koninklijke Philips Electronics N.V., Eindhoven (NL)

( * ) Notice: Subject to any disclaimer, the term of this patent is extended or adjusted under 35 U.S.C. 154(b) by 132 days.

(21) Appl. No.: 10/210,842

(22) Filed: Jul. 31, 2002

(65) Prior Publication Data

US 2003/0043138 A1 Mar. 6, 2003

(30) Foreign Application Priority Data

Aug. 24, 2001 (GB) ..... 0120541
Jul. 3, 2002 (GB) ..... 0205349

(51) Int. Cl.[7] ..... G09G 5/00
(52) U.S. Cl. ..... 345/204; 345/87
(58) Field of Search ..... 345/87, 90, 93, 345/96–98, 904, 204, 208–210, 54, 55, 58

(56) References Cited

U.S. PATENT DOCUMENTS 4,298,866 A 11/1981 Hodemaekers ..... 340/713
5,191,455 A * 3/1993 Hashimoto et al. ..... 345/96
5,428,370 A * 6/1995 Knapp et al. ..... 345/205
5,751,279 A * 5/1998 Okumura ..... 345/212
5,812,106 A * 9/1998 Hughes ..... 345/90
5,905,484 A * 5/1999 Verhulst ..... 345/98
6,424,330 B1 * 7/2002 Johnson ..... 345/96

FOREIGN PATENT DOCUMENTS

WO WO9957706 11/1999

OTHER PUBLICATIONS

Patent Abstracts of Japan, Azuma Hideaki, "Liquid Crystal Display device And Its Adjusting Method," Publication No. 10246879, Sep. 14, 1998, Application No. 09051535, Mar. 6, 1997.

* cited by examiner

*Primary Examiner*—Henry N. Tran

(57) ABSTRACT

A matrix display device (100) comprises an array of pixels (25) for producing a display output in response to voltages applied by drive circuit means (10,16,68). Each pixel (25) has a cell (18) comprising electro-optical material between two electrodes (5,6), the polarity of the voltage applied across the electrodes of each cell being periodically inverted. The device includes correction means (72) for modifying voltages generated by the drive circuit means (10,16,68) to compensate for display artefacts, such as flicker. The correction means comprises a measurement pixel (25*a*) and means for generating for each of the voltage polarities applied across the electrodes (18*a*) of the cells (18) a respective signal indicative of the capacitance of the measurement pixel cell, the correction means (72) modifying voltages generated by the drive circuit means (10,16,68) in response to said signals.

20 Claims, 5 Drawing Sheets

DISPLAY DEVICE

The present invention relates to a display device, and more particularly to display devices comprising an electro-optical material such as liquid crystal (LC) between two electrodes. Display devices of this type are typically used in televisions, computer monitors, and mobile telephones, for example.

A common display device of this form is an AMLCD (active matrix liquid crystal display). An example is described in U.S. Pat. No. 5,130,829, the contents of which are incorporated herein as reference material. In this device, an array of pixels is provided, arranged in rows and columns. Each pixel comprises an electro-optic cell, which includes LC between two electrodes, and an associated switching device, typically a thin film transistor (TFT).

The display is driven by applying alternating voltages to the array of pixels to produce the displayed image. Alternating voltages are used to avoid degradation of the electro-optical material. Each time a pixel is addressed (for each displayed frame), it is driven to the opposite polarity, that is, an inversion drive scheme is employed. However, it has been found that, for a number of reasons, a parasitic DC component may develop across the cells. This is particularly the case when the cells have an asymmetrical structure, as for example in reflective display devices where the device includes a reflector, or electrodes of the cells themselves are reflective. Kickback, a phenomena well known in the art of AMLCDs, is, for example, another cause of a DC component across the cells. These DC components affect the pixel voltage differently when a pixel is charged to opposite polarities in successive frames. Thus, when the absolute value of the drive voltage applied to a pixel in successive frames is the same, the DC component will result in different absolute voltages evolving on the pixel in each frame, leading to visible artefacts in the form of flicker.

FIG. 1 shows a plot of a pixel's LC cell transmission T against the applied voltage V across the cell. It can be seen that the transmission is the same for opposite polarity voltages of equal magnitude. A parasitic DC component, or DC offset, d, is shown on the plot. The driving voltage Vcol applied by an associated column address conductor to the cell is therefore offset. For a positive frame, the magnitude of the voltage across the cell is Vcol+d. For a negative frame, the voltage magnitude across the cell is Vcol−d. It can be seen that the transmission level for the opposite polarity frames for a given value of Vcol are different and vary by an amount, f %. Therefore, for a steady driving voltage of magnitude Vcol, the cell transmission will change by f % each frame period. This causes flicker at half the frame frequency.

To reduce the flicker exhibited in this way, it is well known to adjust the voltage applied across the cell. For example, this can be done by adjusting the voltage on the common electrode. Typically, in current manufacturing processes, the common electrode voltage levels of displays are adjusted manually to correct for flicker effects, which is a time-consuming and expensive process. Also, this does not compensate for changes of the parasitic DC component during the lifetime of the display. In particular, the magnitude of the DC component may change if the drive frequency of the display is changed. For example, mobile telephones may have different modes of operation such as normal and low power modes which utilise different drive frequencies.

WO99/57706 (of the present applicant), the contents of which are incorporated herein by way of reference material, discloses a display device wherein the voltage across pixels in an extra row outside the area used to display an image is measured. The control voltages for the display device are then adjusted in response to the measured voltage by circuitry included in the device to counteract flicker.

The present inventors have found this technique may be hampered by the fact that the measured pixel voltage swings rapidly over a wide range of values and the voltage measurement is susceptible to noise. This reduces the accuracy and reliability of the flicker correction, particularly as four separate voltage measurements are required to calculate the required degree of correction.

It is an object of the present invention to provide a matrix display device which is operable to counteract the effects of a parasitic DC component on its operation in an improved manner.

A matrix display device comprising an array of pixels for producing a display output in response to voltages applied by drive circuit means, each pixel having a cell comprising electro-optical material between two electrodes, the polarity of the voltage applied across the electrodes of each cell being periodically inverted, and correction means for modifying voltages generated by the drive circuit means to compensate for display artefacts, wherein the correction means comprises a measurement pixel and means for generating for each of the voltage polarities applied across the electrodes of the cells a respective signal indicative of the capacitance of the measurement pixel cell, the correction means modifying voltages generated by the drive circuit means in response to said signals.

The capacitance of an electro-optical cell such as a LC pixel is directly related to its transmissivity, whereas there may be a time lag between the application of a voltage across the pixel and the LC moving to its final position in response thereto. Thus, measurement of the capacitance of a measurement pixel (rather than the voltages present across it as a result of normal addressing cycles) gives a more accurate indication of the correction needed to counteract a parasitic DC component across the pixels and compensate for flicker.

In a preferred embodiment, the correction means comprises means for applying a voltage pulse across the measurement pixel cell, and the generating means receives the resulting voltage change across the cell. The generating means may comprise means for decoupling the resulting voltage change from other voltages present across the measurement pixel cell.

Preferably, one cell electrode is common to all cells in the pixel array and the correction means is arranged to modify the voltages applied to the common electrode in response to said signals.

One or more of the pixels of the display itself may be employed as measurement pixels. Preferably, one or more pixels outside the display area visible to a user in the finished display device, referred to herein as "dummy pixels" are utilised. One or more rows of dummy pixels may be employed. The one or more dummy pixels may be scaled versions of the pixels forming the display area. The device may include a plurality of measurement pixels, with their pixel electrodes electrically connected together, wherein the pixel electrode is the second electrode of each cell opposite the common electrode.

In another preferred embodiment, the area of a measurement pixel electrode is reduced relative to the pixel electrodes of pixels in the display area by an amount substantially equal to the area of an electrical connection between the measurement pixel and an adjacent measurement pixel.

The voltages modified by the correction means may be the data signals applied to the column electrodes, the row selection signals applied to the row electrodes and/or the signal applied to the common electrode where included. In a two-level or a common electrode modulation drive scheme, the adjustment may consist of the addition of an appropriate DC voltage to the common electrode. In a four-level drive scheme the adjustment may consist of shifting two of the row drive voltages to counteract kickback effects, and adding an appropriate DC to the common electrode to counteract the DC due to asymmetry of the pixel.

The display device may be of the active or the passive type. In an active type display, a common electrode is usually provided opposite an array of pixel electrodes, but a common electrode is not necessary in, for example, an "in-plane switching" type display. Where a common electrode is employed, the driver means further comprises a common electrode driver for applying a signal to the common electrode.

The invention further provides a method of driving a matrix display device comprising an array of pixels for producing a display output in response to voltages applied by drive circuit means, each pixel having a cell comprising electro-optical material between two electrodes, the polarity of the voltage applied across the electrodes of each cell being periodically inverted, and correction means for modifying voltages generated by the drive circuit means to compensate for display artefacts, the correction means comprising a measurement pixel, and the method comprising the steps of:

(a) generating for each of the voltage polarities a respective signal indicative of the capacitance of the measurement pixel cell; and (b) modifying voltages generated by the drive circuit means in response to said signals.

Step (a) preferably comprises the steps of applying a voltage pulse across the measurement pixel cell and monitoring the resulting voltage change across the cell, for each of the voltage polarities. Advantageously, where the measurement pixel includes a storage capacitor, the voltage pulse may be applied to its cell via the capacitor.

Each signal provided by the generating means is preferably indicative of substantially the instantaneous capacitance of the measurement pixel cell at a predetermined point in a frame period, wherein the periodic inversion of the polarity of the voltages applied across the electrodes of the measurement pixel cell occurs at the start of consecutive frame periods. Preferably, the generating means generates said signals towards the end of the frame period for each voltage polarity. In another embodiment, the generating means generates said signals towards the beginning and towards the end of the frame period for each voltage polarity. In either case, the signals generated can be used to determine how to modify the voltages generated by the drive circuit means to counteract display artefacts. In a further embodiment, signals generated by the generating means during a frame period of each polarity are integrated and the voltage modification is derived from the results. Differences in the evolution of the measurement pixel cell capacitance over a frame periods of different polarity are indicative of the presence of flicker, so an approach such as integration may be used to provide a measure of such differences.

These and other advantageous features in accordance with aspects of the present invention are illustrated embodiments of the invention which will now be described with reference to the accompanying schematic drawings, wherein.

Figure 2:
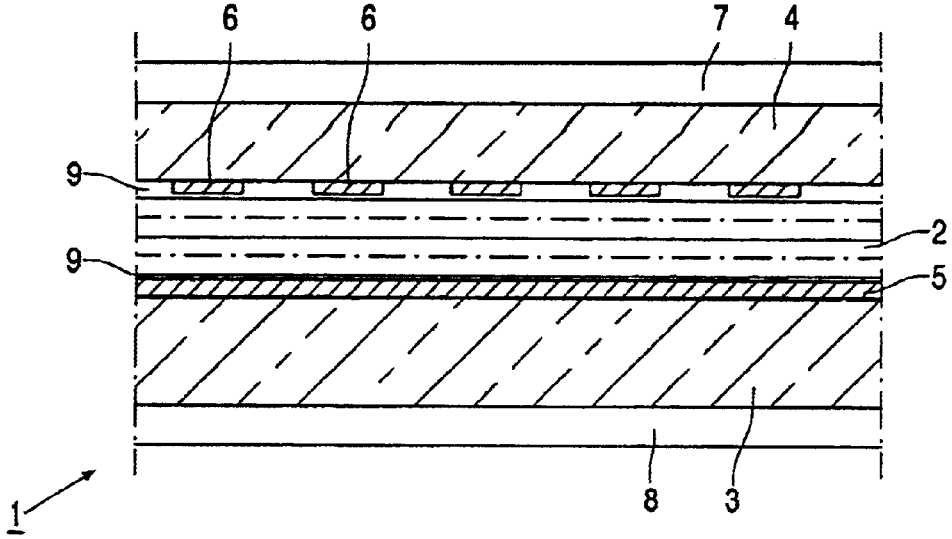
FIG. 2 shows a transverse cross-sectional view of part of a LC display device.

FIG. 2 is a cross-sectional view of part of a LC display device 1. Only a few pixels are illustrated for clarity. Twisted nematic LC material 2 is provided between two substrates 3,4 formed of glass, for example. Pixel electrodes 6 are supported on one substrate 4, whilst a reflecting common electrode 5 is provided over the opposing surface of the other substrate 3. In a transmissive display for example, the electrodes 5 and 6 are formed of a transparent material, such as indium tin oxide (ITO). In a reflective type of display, the electrodes on only one substrate may be transparent. Each pixel electrode, an opposing portion of the common electrode 5 and the intervening LC material 2 together form a LC cell of a pixel. Polarisers 7 and 8 are mounted on the outer surfaces of respective substrates 3,4, with their directions of polarisation mutually perpendicular. Respective orientation layers 9 are provided over the pixel and common electrodes 6,5 to orient the LC material 2 on the inner walls of the substrates 3,4. On application of a voltage across a pixel, the LC aligns itself in the resulting electric field, altering the transmissivity of the pixel.

Figure 3:
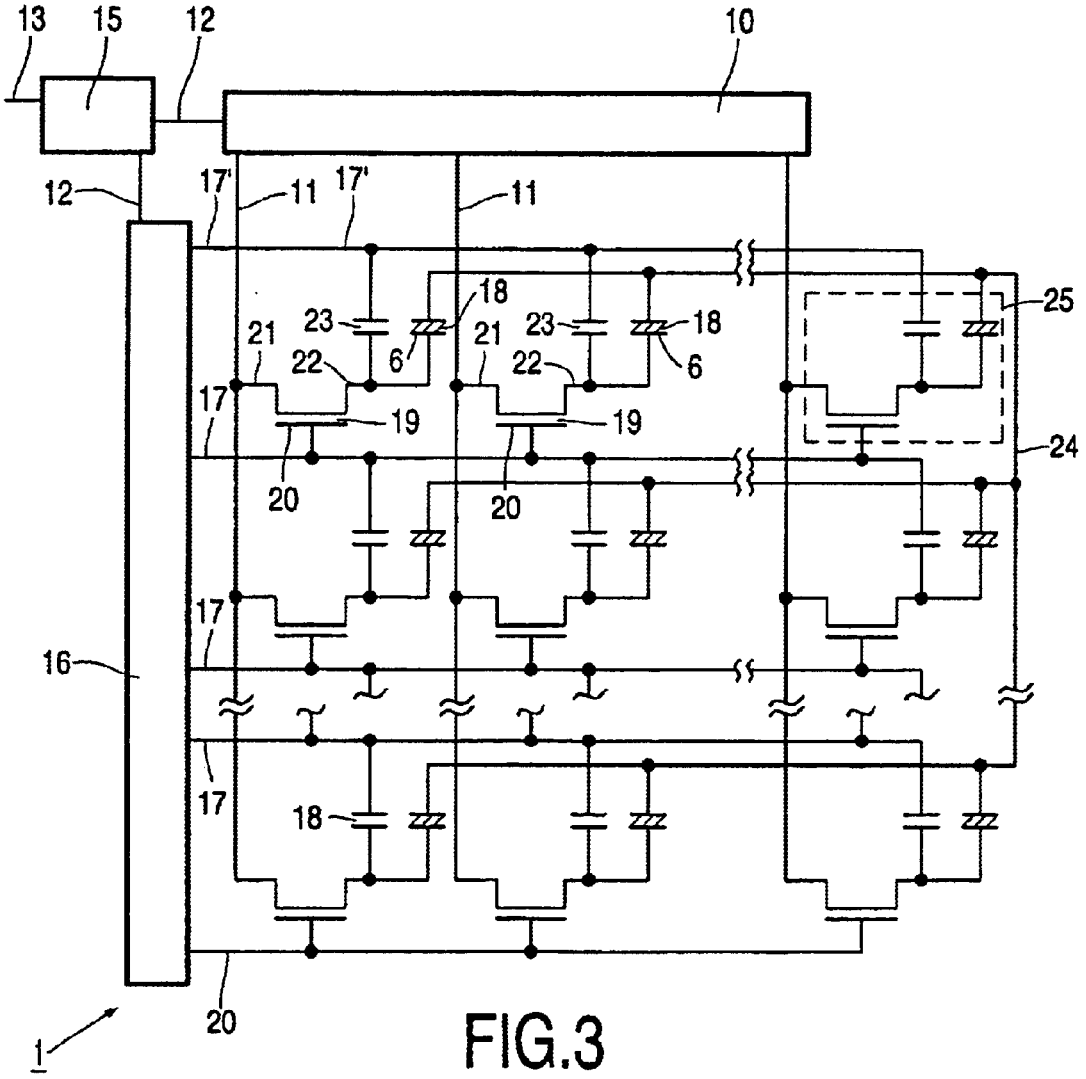
FIG. 3 shows a circuit diagram of an AMLCD.

The main elements of a typical active matrix display device are shown in FIG. 3. Each pixel 25 of the display comprises a switching element 19 and an LC cell 18. Each switching element is coupled to a respective one of a set of row or selection electrodes 17 and a respective one of a set of data or column electrodes 11. The row electrodes are consecutively selected by row selection signals generated by a row driver circuit 16 connected to each row electrode 17. The column electrodes are connected to a column driver circuit 10 which applies data signals thereto. If necessary, data inputted to the display device is first processed by a processor 15. Data and synchronisation pulses are fed from the processor 15 to the row and column driver circuits 16,10 along drive lines 12.

The switching elements 19 in this case are TFTs. Instead of TFTs, two-pole switching elements such as MIMs or diodes may be used, for example. The gate electrode 20 of each TFT is electrically connected to a respective row electrode 17, the source electrode 21 thereof is electrically connected to a respective column electrode 11, and the drain electrode 22 thereof is electrically connected to the pixel electrode 6 of the respective LC cell 18. When each TFT 19 is selected by a row selection signal on the respective row electrode 17, the voltage present at the corresponding column electrode 11 is transferred via the TFT 19 to the respective pixel electrode.

The display device of FIG. 3 includes an auxiliary or storage capacitor 23 for each pixel 25. The capacitor 23 is shown to be connected between the common point of the drain electrode 22 and the LC cell 18, and the row electrode 17 of the previous row of pixels. In other configurations, the capacitor may be connected between said common point and a subsequent row electrode, or between said common point and a separate capacitor line. To reduce non-uniformity in the display, an extra row electrode 17' is provided.

Figure 4:
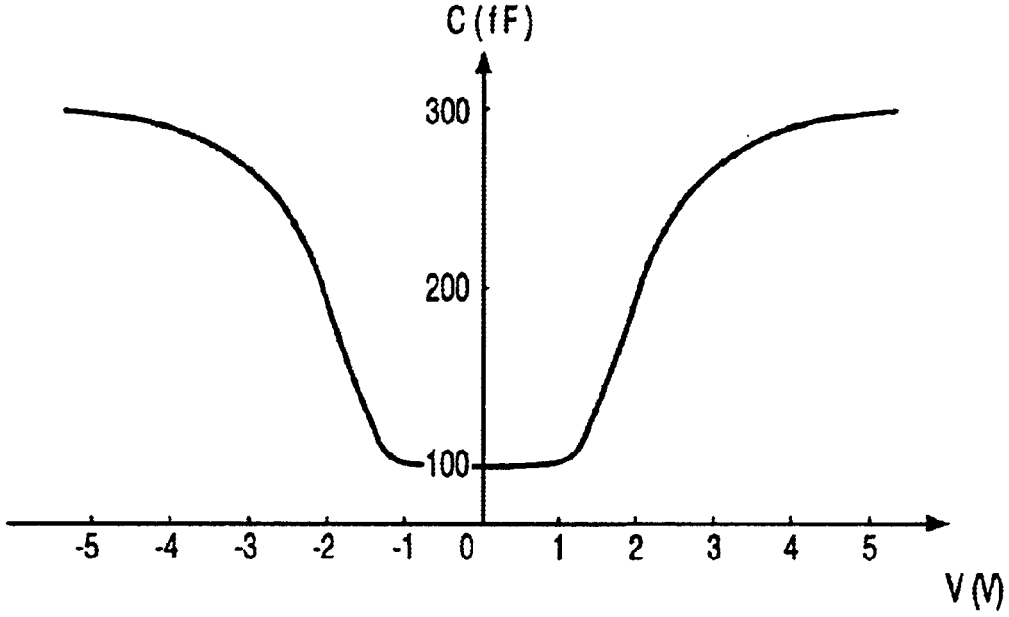
FIG. 4 shows a graph of capacitance against applied voltage for a typical LC cell.

The capacitance C of an LC cell varies with the voltage V applied across it, and FIG. 4 shows a typical relationship between these quantities for static voltages. After the transition from a positive to a negative polarity frame during the addressing of a pixel, the parasitic DC component adds to the magnitude of the voltage that the pixel is charged to, thus increasing the magnitude of the voltage across the LC material itself (relative to the same grey level in the previous frame). From FIG. 4 it is therefore apparent that the capacitance of the cell will increase during the negative frame time. Conversely, in a positive frame, the DC component subtracts from the magnitude of the pixel voltage, decreasing the magnitude of the voltage across the LC material, and so decreasing the cell capacitance.

Figure 5:
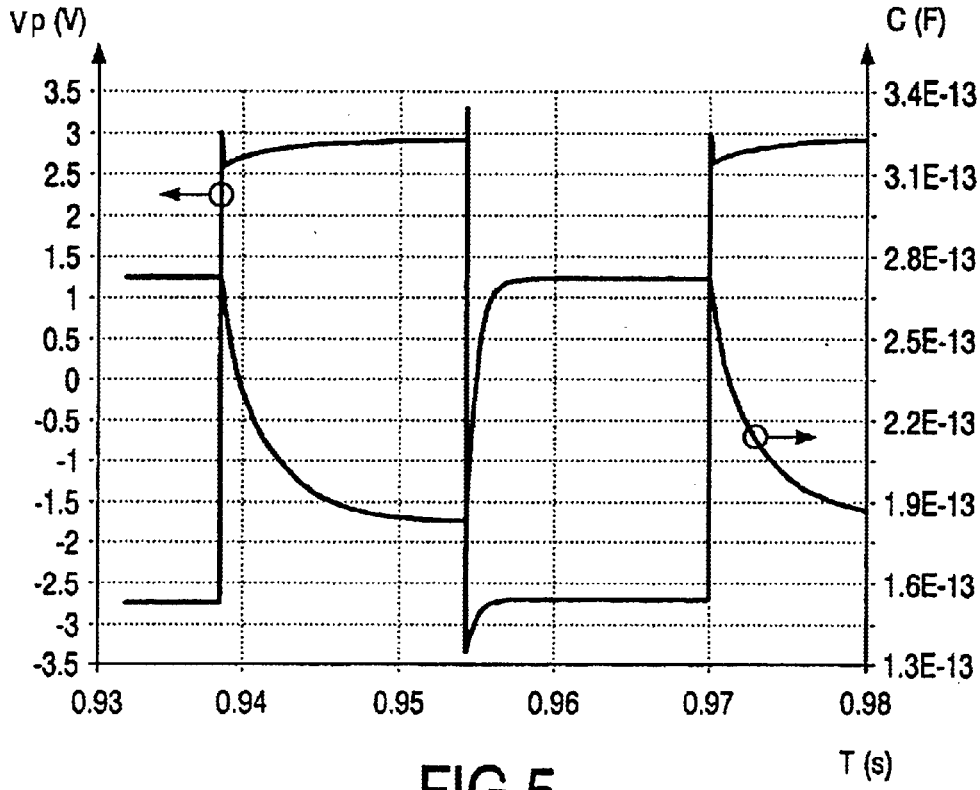
FIGS. 5 and 6 show graphs of pixel pad voltage and capacitance against time for a LC cell, without and with flicker correction, respectively.
Figure 6:
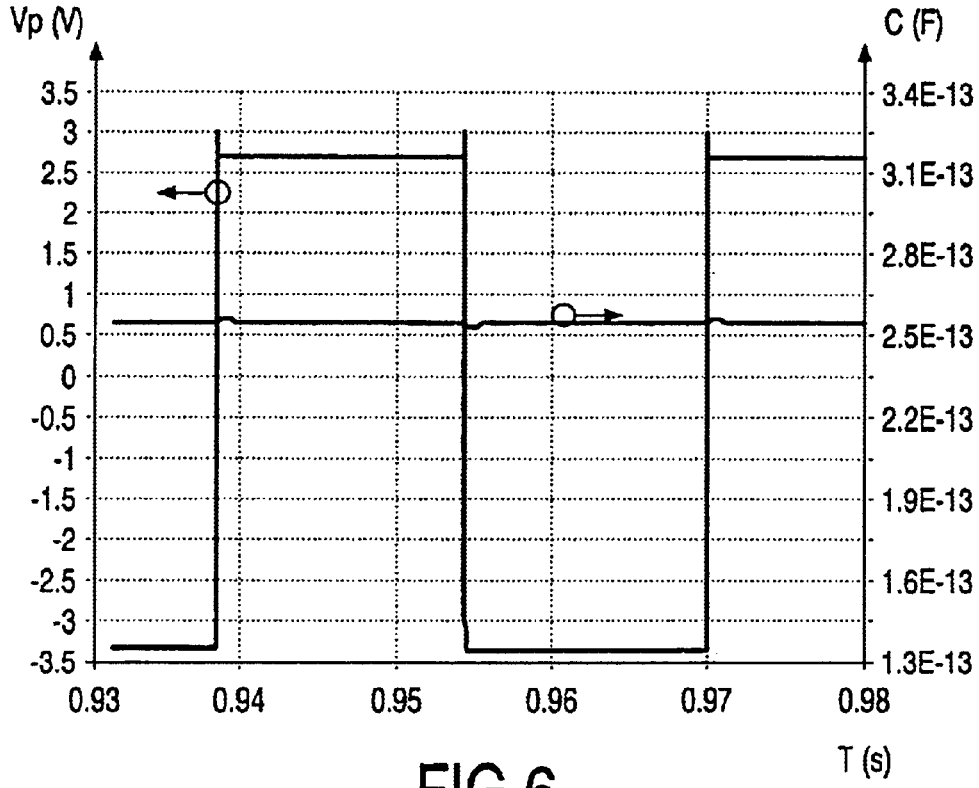

The effects of the parasitic DC component on the voltage at a pixel electrode, Vp, and the capacitance of the pixel cell, C, against time, T, in consecutive frames are illustrated in FIG. 5. The capacitance axis is offset from zero to show the capacitance changes more clearly. As noted above, the cell capacitance is directly related to its transmissivity and so the presence of flicker is apparent from FIG. 5. FIG. 6 shows the same frames as FIG. 5, but with the application of flicker correction to the common electrode of the display in accordance with the invention. It can be seen that the variation in capacitance, and hence flicker, is substantially reduced.

Figure 7:
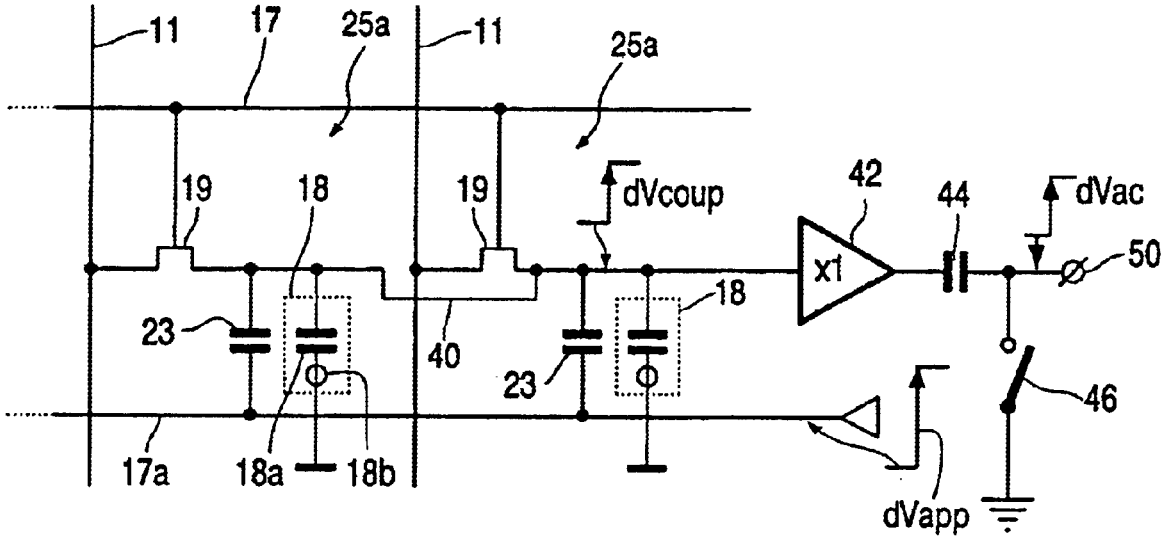
FIG. 7 is a circuit diagram illustrating an arrangement for measuring LC cell capacitance, in accordance with an embodiment of the invention.

An example of a circuit for measuring the capacitance of a LC cell in an active matrix device is shown in FIG. 7. Each LC cell 18 is represented in FIG. 7 as consisting of the pair 18*a* of electrodes forming the cell in series with a voltage source 18*b*, representing the parasitic DC component. A pair of measurement pixels 25*a* is shown. Their pixel electrodes are electrically connected together by a link 40. This serves to scale up the size of the capacitance to be measured, thereby improving the signal to noise ratio of the capacitance measurements. Whilst a pair of pixels is shown by way of illustration, it will be appreciated that more than two pixels may be linked together in this way to increase further the measured capacitance. The pixel electrodes are connected to a high input impedance buffer 42. This is in turn connected to one side of a capacitor 44. The other side of the capacitor is connected via an output 50 to flicker correction processing means (not shown) for calculating the required flicker correction. A normally open switch 46 is connected between the other side of the capacitor and ground.

Figure 1:
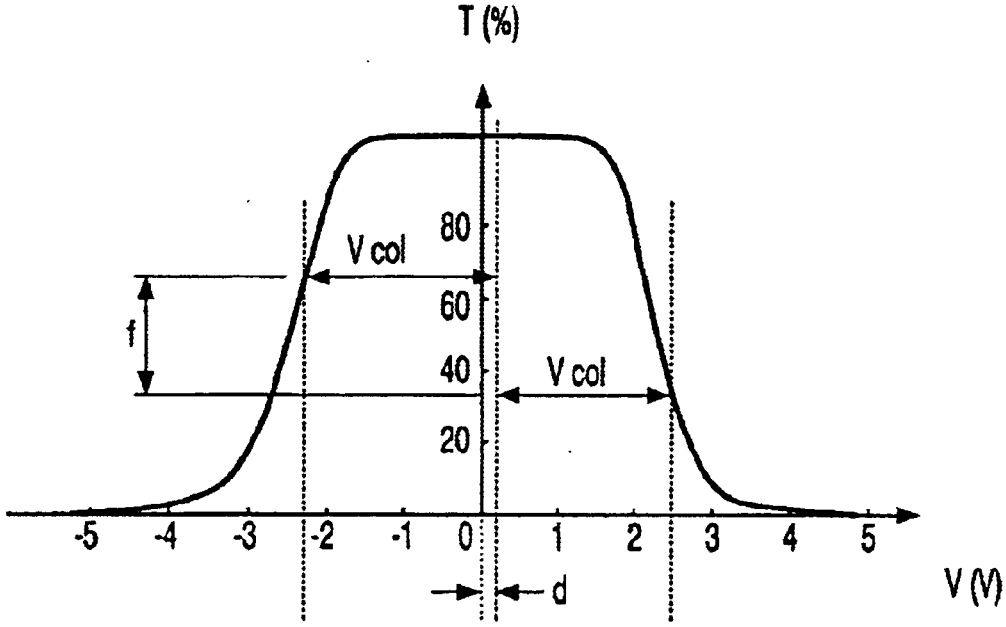
FIG. 1 shows a graph of transmission against applied voltage for a typical LC cell.

Using the circuit of FIG. 7, each capacitance measurement is achieved by firstly charging each pixel 25*a* to an intermediate voltage or grey level via the respective column electrode 11 and switching element 19. The pixels are preferably addressed with data signals corresponding to a mid-range grey scale. As can be seen from FIG. 1, this enhances the flicker effect as the rate of change of transmission with voltage is greatest around a mid-range grey level, or around 50% transmission.

A voltage edge or pulse, dVapp, is then applied to the bottom plate of the storage capacitors 23, in this case via row electrode 17*a*. This pulse may be applied by the flicker correction processing means or by the row driver circuit, for example. It in turn couples a small voltage change, dVcoup, into each LC cell 18 which is dependent on the capacitance of the LC cell.

Capacitor 44, in combination with the switch 46, is used to decouple a voltage pulse dVac from the alternating voltage applied to the LC cell in opposite polarity frames. Once the pixels 25*a* have been charged, and immediately before application of the pulse dVapp, the switch 46 is closed briefly to discharge the capacitor 44. When dVapp is applied, the small voltage change dVac alone therefore appears at the output 50, decoupled from the grey level voltage, which may for example be an order of magnitude greater dVac need only be a single polarity for both frame polarities. This, and the decoupling capacitor 44, reduces the range of dVac, thereby simplifying the electronics of the flicker correction processing means (not shown).

It can be seen that the voltage change at the output 50, dVac, is related to the LC cell capacitance, $C_{LC}$, as follows:

$$dVac = dVapp \times \frac{C_{st}}{C_{st} + C_{LC}}$$

where $C_{st}$ is the capacitance of the storage capacitor 23. Thus $C_{LC}$ can be calculated from dVac. Using this type of approach, dVac provides a measure of the magnitude of $C_{LC}$ relative to another, known capacitance ($C_{st}$ in this case. It will be appreciated that the pulse may similarly be applied via another known capacitance, either via an additional capacitor, or another capacitance already present in the pixel. For example the parasitic drain capacitance of the TFT 19 may be used by applying the pulse along the respective row conductor 17.

An advantage of applying the voltage edge via the storage capacitors 23 (or another capacitance already present in the pixels) is that the capacitance ratios of the pixel capacitances are unchanged in the measurement pixels 25*a*, thereby ensuring these pixels behave in substantially the same way as those in the display area with respect to kickback. The applied voltage edge, dVapp, should preferably be kept relatively small and short to ensure that the voltage coupled through the storage capacitor 23 does not affect the LC cell 18 by significantly changing the LC orientation. The buffer 42 has a high impedance to ensure it does not substantially affect the amount of charge stored in the pixels 25*a*.

Figure 8:
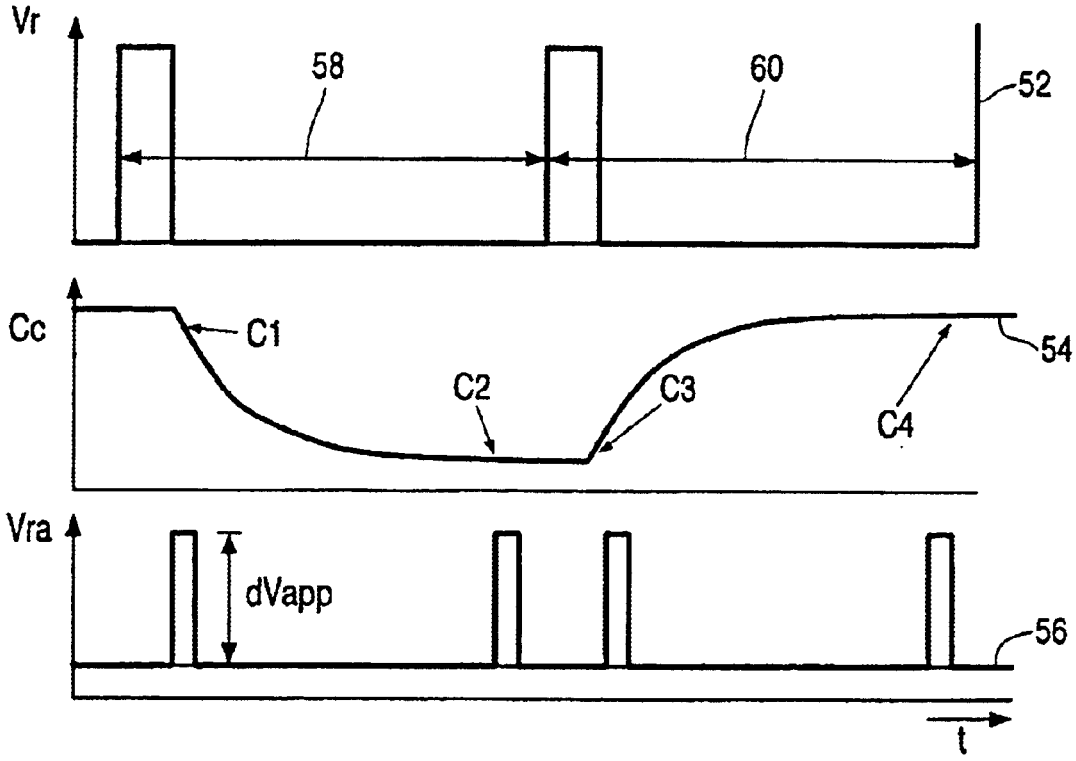
FIG. 8 shows graphs to illustrate the approximate timing of operation of the circuit of FIG. 7.

The amount of flicker correction required may be calculated by taking two measurements for each polarity of frame. The approximate timing of these measurements is schematically illustrated in FIG. 8, and is now described with reference to the circuit of FIG. 7. Waveform 52 represents the voltage, Vr, applied to row conductor 17, waveform 54 represents the capacitance, Cc, of the LC cells 18, and waveform 56 represents the voltage, Vra, applied to row conductor 17*a*. The waveforms are plotted against time, t. The plots are shown for two frames, a positive frame period having a duration 58, and a negative frame period of duration 60. As illustrated by waveform 56, pulses of magnitude dVapp are applied to row conductor 17*a* close to the beginning and the end of each frame. This generates four pulses Vac at output 50, providing four capacitance measurements, corresponding to points C1 to C4 on waveform 54. The parasitic DC component of the pixel drive voltages causes the pixel capacitance to evolve differently in different polarity frames. Flicker is therefore minimised when C1−C2=−(C3−C4).

As the addressing pulses applied to row conductor 17 are short compared to the frame time, two capacitance measurements may be sufficient. This is because the capacitance change over the length of the pulse will be small, and so the capacitance measured close to the end of a frame is likely to be substantially the same as that measured close to the beginning of the next frame. For example, as illustrated in FIG. 8, C1 is approximately equal to C4, and C2 is approximately equal to C3. Thus, flicker is minimised when the difference between C2 and C4 is minimised. Ideally, the pixels are driven such that C2 equals C4, but in practice it is likely there will be a degree of leakage from the LC cells through the associated TFTs.

It will be appreciated that other techniques may be used to measure the capacitance of an LC cell in a measurement pixel (or pixels, where a plurality of interlinked pixels are employed for the measurement), besides that described above. For example, the capacitance may be deduced by applying a small oscillating voltage to the pixel and measuring the current needed to achieve it. Alternatively, the measurement pixel(s) may be shorted to a known capacitance. The amount of current flow occurring or the final voltage which evolves across the pixel(s) will be indicative of the capacitance of the pixel(s). With these approaches, it may be necessary to use dummy pixels to avoid degradation of the display by the measurement processes.

Also, for a given capacitance measurement technique, it will be apparent that other calculation methods may be used to derive a measure of the amount of flicker present. For example, as illustrated in FIG. 5, the parasitic DC component(s) give rise to different profiles for the capacitance change in opposite polarity frames. Thus, capacitance measurements may be taken at a specific time or times during the course of a frame of each polarity, in addition to, or instead of measurements close to the beginning and/or end of each frame as discussed above, to give a measure of the difference between the respective profiles.

The calculations necessary to determine the correction needed to counteract the effects of a parasitic DC from the measurements described above may be carried out by the flicker correction processing means using suitable algorithms or "look-up" tables. These may be stored in discrete ICs or in circuits integrated into the display by formation on one or both of the substrates of the display. In another approach, the calculations may be carried out in the row and column driver ICs of the display, again either in discrete ICs or in integrated circuitry on one or both of the display substrates.

Alternatively, capacitance measurements for opposite polarity frames may more simply be compared and the result fed to a digital or analogue integrator. In response to the result of the comparison, the integrator may increase, decrease or leave unchanged the amount of modification to be applied to voltages generated by the device drive circuits in order to compensate for flicker.

Figure 9:
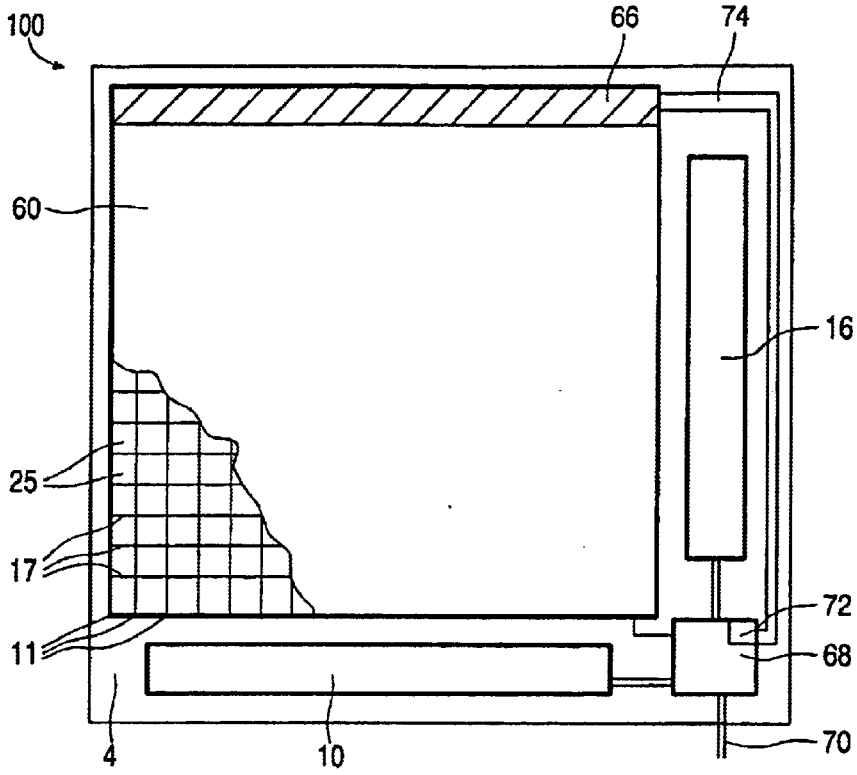
FIG. 9 shows a plan view of a matrix display device in accordance with an embodiment of the invention.

A preferred configuration of a display device according to the present invention is shown schematically in FIG. 9. The display device 100 is an AMLCD having a substrate 4 and a display area 61 defined thereon, comprising an array of pixels. Each pixel is addressed by corresponding row and column conductors, 17 and 11, respectively, as in conventional AMLCD devices. A row driver circuit 16 and a column driver circuit 10 are located adjacent respective edges of the panel. The row driver circuit 16 selects one row of pixels at a time. Each pixel in the selected row of pixels is then addressed in sequence with data signals from the column driver circuit 10 via the associated column conductors 11.

Dummy pixels 66 are located adjacent another edge of the display area 60. They may be addressed by the row and column conductors 17,11 in the same way as the pixels in the display area.

The AMLCD 100 further includes a timing and control circuit 68 to which a video signal is applied via line 70. Circuit 68 provides data signals to the column driver circuit 10, timing signals to the row driver circuit 62 and a voltage signal to the common electrode (not shown). The control circuit 63 includes flicker correction processing means 72. Signals are sent between control circuit 63 and the dummy pixels 66 along one or more lines 74.

It may be desirable to screen lines 74, line 70 and/or other connectors to and/or within the display to reduce electromagnetic interference effects. Within the area of the display substrates 3,4, grounded conductive screening layers may conveniently be formed above and/or below the lines using extra portions of layers used to form the elements of the display and/or by inclusion of one or more extra layers on one or both of the faces of either or both substrates. More particularly, a structure similar in principle to a triaxial cable may be formed. This comprises a grounded shield layer above and below the signal line, and two further conductive intervening layers between the signal line and each shield layer. The intervening layers are connected to the signal line via a high impedance, unity gain buffer so that the signal line has negligible parasitic capacitance due to the shield layers as the intervening layers are always held at substantially the same potential as the signal line.

The control circuit 63 and/or the flicker correction processing means 72 may be provided in ICs remote from those of the row and column driver circuits, or incorporated within them. Alternatively, one or more of these circuits may be provided on the display substrate 4, alongside the display area 60, using for example polysilicon technology, as illustrated in FIG. 9.

Figure 10:
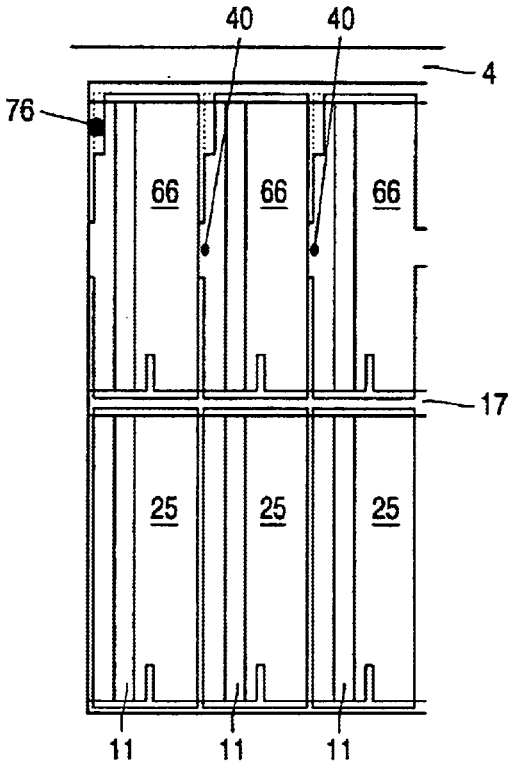
FIG. 10 shows a plan view of pixels and dummy pixels in part of a display device in accordance with an embodiment of the invention.

FIG. 10 illustrates in plan view a few of the dummy pixels 66, alongside pixels 25 of the visible display area 60. In this embodiment, the links 40 between adjacent dummy pixels conveniently consist of extensions of the respective pixel electrodes. In order to counteract the resulting increase in the pixel electrode area a portion of the pixel electrode of substantially the same area as the extension is omitted from elsewhere in the pixel electrode. In the illustrated example, a portion 76 (shown in dotted outline) is omitted from one corner of each pixel electrode of the dummy pixels.

From reading the present disclosure, other variations and modifications will be apparent to persons skilled in the art. Such variations and modifications may involve equivalent and other features which are already known in the art, and which may be used instead of or in addition to features already described herein.

Although claims have been formulated in this Application to particular combinations of features, it should be understood that the scope of the disclosure of the present invention also includes any novel feature or any novel combination of features disclosed herein either explicitly or implicitly or any generalisation thereof, whether or not it relates to the same invention as presently claimed in any claim and whether or not it mitigates any or all of the same technical problems as does the present invention.

The Applicants hereby give notice that new claims may be formulated to such features and/or combinations of such features during the prosecution of the present Application or of any further Application derived therefrom.

What is claimed is:

1. A matrix display device comprising an array of pixels for producing a display output in response to voltages applied by a drive circuit, each pixel having a cell comprising electro-optical material between two electrodes, the polarity of the voltage applied across the electrodes of each cell being periodically inverted, and a correction circuit that is configured to modify voltages generated by the drive circuit to compensate for display artefacts, wherein the correction circuit comprises a measurement pixel and a generating circuit that is configured to generate, for each of the voltage polarities applied across the electrodes of the cells, a respective signal that is indicative of capacitance of the measurement pixel cell, and the correction circuit modifies the voltages generated by the drive circuit in response to said signals.

2. A device of claim 1 wherein the correction circuit is further configured to apply a voltage pulse across the measurement pixel cell, and the generating circuit is further configured to receive the resulting voltage change across the cell.

3. A device of claim 2 wherein the generating circuit is further configured to decouple the resulting voltage change from other voltages present across the measurement pixel cell.

4. A device of claim 3 wherein one cell electrode is common to all cells in the pixel array and the correction circuit is configured to modify the voltages applied to the common electrode in response to said signals.

5. A device of claim 4 wherein the array of pixels produces the display output in a display area, and the measurement pixel is a dummy pixel located outside the display area.

6. A device of claim 4 wherein a second electrode of each cell is a pixel electrode opposite the common electrode, and the device includes a plurality of measurement pixels, the pixel electrodes of the measurement pixels being electrically connected together.

7. A device of claim 6 wherein an area of a measurement pixel electrode is reduced relative to the pixel electrodes of pixels in the display area by an amount substantially equal to an area of an electrical connection between the measurement pixel and an adjacent measurement pixel.

8. A device of claim 3 wherein the array of pixels produces the display output in a display area, and the measurement pixel is a dummy pixel located outside the display area.

9. A device of claim 1 wherein one cell electrode is common to all cells in the pixel array and the correction circuit is configured to modify the voltages applied to the common electrode in response to said signals.

10. A device of claim 9 wherein a second electrode of each cell is a pixel electrode opposite the common electrode, and the device includes a plurality of measurement pixels, the pixel electrodes of the measurement pixels being electrically connected together.

11. A device of claim 9 wherein an area of a measurement pixel electrode is reduced relative to the pixel electrodes of pixels in the display area by an amount substantially equal to an area of an electrical connection between the measurement pixel and an adjacent measurement pixel.

12. A device of claim 1 wherein the array of pixels produces the display output in a display area, and the measurement pixel is a dummy pixel located outside the display area.

13. A device of claim 5 wherein a second electrode of each cell is a pixel electrode opposite the common electrode, and the device includes a plurality of measurement pixels, the pixel electrodes of the measurement pixels being electrically connected together.

14. A method of driving display device comprising an array of pixels for producing a display output in response to voltages applied by a drive circuit, each pixel having a cell comprising electro-optical material between two electrodes, the polarity of the voltage applied across the electrodes of each cell being periodically inverted, and a correction circuit for modifying voltages generated by the drive circuit to compensate for display artefacts, the correction circuit comprising a measurement pixel, and the method comprising:

generating, for each of the voltage polarizes, a respective signal indicative of the capacitance of the measurement pixel cell; and modifying the voltages generated by the drive circuit in response to said signals.

15. A method of claim 14 wherein generating the respective signals comprises:

applying a voltage pulse across the measurement pixel cell and monitoring the resulting voltage change across the cell, for each of the voltage polarities.

16. A method of claim 15 wherein the measurement pixel includes a storage capacitor, and voltage pulse is applied to its cell via the capacitor.

17. A method of claim 16 wherein the periodic inversion of the polarity of the voltages applied across the electrodes of the measurement pixel cell occurs at each start of consecutive frame periods, said signals being generated towards an end of the frame period for each voltage polarity.

18. A method of claim 15 wherein the periodic inversion of the polarity of the voltages applied across the electrodes of the measurement pixel cell occurs at each start of consecutive frame periods, said signals being generated towards an end of the frame period for each voltage polarity.

19. A method of claim 14 wherein the periodic inversion of the polarity of the voltages applied across the electrodes of the measurement pixel cell occurs at each start of consecutive frame periods, said signals being generated towards an end of the frame period for each voltage polarity.

20. A method of claim 19 wherein said signals are generated towards a begining and towards the end of the frame period for each voltage polarity.

* * * * *